US006914564B2

(12) United States Patent
Barras et al.

(10) Patent No.: US 6,914,564 B2
(45) Date of Patent: Jul. 5, 2005

(54) WATCHBAND ANTENNA

(75) Inventors: David Barras, Schlieren (CH); Brice Robin, La Chaux-de-Fonds (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 48 days.

(21) Appl. No.: 10/478,659

(22) PCT Filed: Jul. 4, 2002

(86) PCT No.: PCT/EP02/07494

§ 371 (c)(1),
(2), (4) Date: Nov. 25, 2003

(87) PCT Pub. No.: WO03/005486

PCT Pub. Date: Jan. 16, 2003

(65) Prior Publication Data

US 2004/0155818 A1 Aug. 12, 2004

(30) Foreign Application Priority Data

Jul. 5, 2001 (EP) ..... 01202593

(51) Int. Cl.[7] ..... H01Q 1/38; G04D 47/00

(52) U.S. Cl. ..... 343/700 MS; 343/702; 343/846; 343/718; 343/803; 343/793; 368/10; 368/278; 368/47; 368/276; 340/573

(58) Field of Search ..... 343/700 MS, 702, 343/846, 718, 803, 793, 795; 342/51, 357; 368/10, 278, 47, 718; 340/573

(56) References Cited

U.S. PATENT DOCUMENTS 4,673,936 A * 6/1987 Kotoh ..... 342/51
4,918,433 A * 4/1990 Moore ..... 340/573.1
5,392,049 A * 2/1995 Gunnarsson ..... 342/42
5,627,548 A * 5/1997 Woo et al. ..... 342/357.06
5,646,634 A 7/1997 Bokhari et al.
5,699,319 A * 12/1997 Skrivervik ..... 368/10
5,821,902 A * 10/1998 Keen ..... 343/700 MS

FOREIGN PATENT DOCUMENTS

| | | |
|---|---|---|
| EP | 982 639 A2 | 3/2000 |
| EP | 993 070 A1 | 4/2000 |
| EP | 1 067 627 A1 | 1/2001 |
| GB | 2 299 898 A | 10/1996 |

OTHER PUBLICATIONS

"GPS Watch—Une montre á quartz analogigue équipée d'un récepteur GPS à très faible consummation", P.A. Farine et al, Congrés européen de chronométrie, CEC 2000, Genève, Suisse, Sep. 28–29, 2000.

"GPS Watch—An Analogue Watch Including a Very Low Power GPS Receiver", P.A. Farine et al, ION GPS 2000 Conference, Salt Lake City, UT, USA, Sep. 19–22, 2000.

* cited by examiner

*Primary Examiner*—Shih-Chao Chen
*Assistant Examiner*—Chuc Tran
(74) *Attorney, Agent, or Firm*—Sughrue Mion, PLLC

(57) ABSTRACT

The invention concerns a patch antenna (20) for a small-sized portable electronic instrument comprising a radiating element (21) separated from a ground plane (23) by a dielectric (22) and comprising feed (25) and ground (26) conductors for electrically connecting said radiating element and said ground plane (23) respectively, to an electric module (6). The ground plane (23) consists of a stamped metal plate including at least a folded foot (**26*a*, 26*b*) outside said ground plane and directly connecting said ground plane (23) to said electronic module (6), said foot (26*a*, 26*b*) forming said ground conductor (26**) of the antenna.

9 Claims, 5 Drawing Sheets

CROSS-SECTION A-A'

WATCHBAND ANTENNA

The present invention generally concerns a patch type antenna for a portable electronic instrument of small volume, particularly for a timepiece. This antenna is more particularly for allowing reception of satellite positioning and navigation signals and thus for being incorporated in a positioning and navigation signal receiver, such as a receiver compatible with the American GPS positioning system, the Russian GLONASS positioning system or even the future European satellite positioning system GALILEO. The invention also concerns a portable electronic instrument including such a patch antenna.

A patch antenna (also called a micro-strip antenna) typically includes a ground plane and a radiating element separated from said ground plane by a dielectric, such as a ceramic material. The general shape of this type of antenna is generally parallelepipedic. Feed and ground conductors are respectively connected to this radiating element and ground plane. These conductors are typically made in the form of a coaxial connector wherein the inner conductor forms the feed conductor and the outer conductor the ground conductor. This type of antenna is particularly used in GPS or similar receivers for receiving positioning signals via satellite.

EP Patent No. 0982 639 describes, for example, an electronic instrument meant to be worn on a user's wrist, this instrument being fitted with a patch type antenna especially for receiving GPS signals. Various variants are presented in this document, the patch antenna being placed in each of these variants in direct proximity to the display device and on the surface of a printed circuit board.

The document "GPS watch—Une montre à quartz analogique équipée d'un récepteur GPS à très faible consommation » by P. -A. Farine et al (Asulab S. A.), European Chronometry Congress, CEC 2000, Geneva, Sep. 28–29, 2000, session 7, communication 19, presents another example of an electronic instrument taking the shape of a wristwatch including a GPS receiver and a patch antenna. In this example, the patch antenna is placed in the 12 o'clock zone of the watch on its ground plane, itself located on the main printed circuit board of the watch. The dimensions of this antenna are approximately of the order of 13×13×4 $mm^2$.

One of the disadvantages of the above solutions lies in the fact that the antenna and its ground plane rest directly on a face of the printed circuit board and in proximity to the electronic components of the instrument, this proximity requiring a particular arrangement of the components and elaboration of a relatively complicate shielding in order to reduce or prevent mutual interference between the antenna and the electronic components, particularly the display device and the electronic module. This shielding considerably complicates the assembly operations of the various elements and components of the electronic instrument.

Another disadvantage of the aforementioned solutions lies in the fact that the exterior of the instrument has to be made of a material that does not interfere with the working of the antenna, particularly a non-metallic material. The aesthetic appearance of the instrument is also dependent on the limited choice of materials able to be used to make the exterior of the instrument.

It is a main object of the present invention to propose an antenna configuration for a portable electronic instrument of small volume which offers better flexibility for the design of the electronic instrument and whose construction makes the use of metallic materials possible, if desired, for making the exterior of the instrument.

It is another object of the present invention to propose such a solution, which however ensures a robust mechanical support for the antenna while facilitating and simplifying its electric connection to the electronic module of the portable instrument.

The present invention thus concerns a patch type antenna whose features are recited in independent claim 1.

The present invention also concerns a portable electronic instrument of small volume, such as a wristwatch, whose features are recited in independent claim 7.

Advantageous embodiments of the present invention form the subject of the dependent claims.

According to the invention, the ground plane of the antenna is advantageously formed of a stamped metal plate including at least one foot bent outside the ground plane and directly connecting the latter to the electronic module, this foot forming the antenna's ground conductor.

According to the invention, the assembly and connection of the antenna is greatly facilitated, although the latter is at a distance from the electronic module. It is in fact unnecessary to provide the instrument with a pair of distinct conductors, such as a coaxial conductor, to feed the antenna, since the ground conductor advantageously forms an integral part of the ground plane of the antenna. Moreover, the arrangement of the antenna is such that the various electronic and electric components of the instrument are located substantially behind the ground plane of the antenna, this proving an advantage in order to reduce interference with the antenna.

Other features and advantages of the present invention will appear more clearly upon reading the following detailed description of a preferred embodiment of the invention, given solely by way of non-limiting example and illustrated by the annexed drawings, in which.

Figure 1:
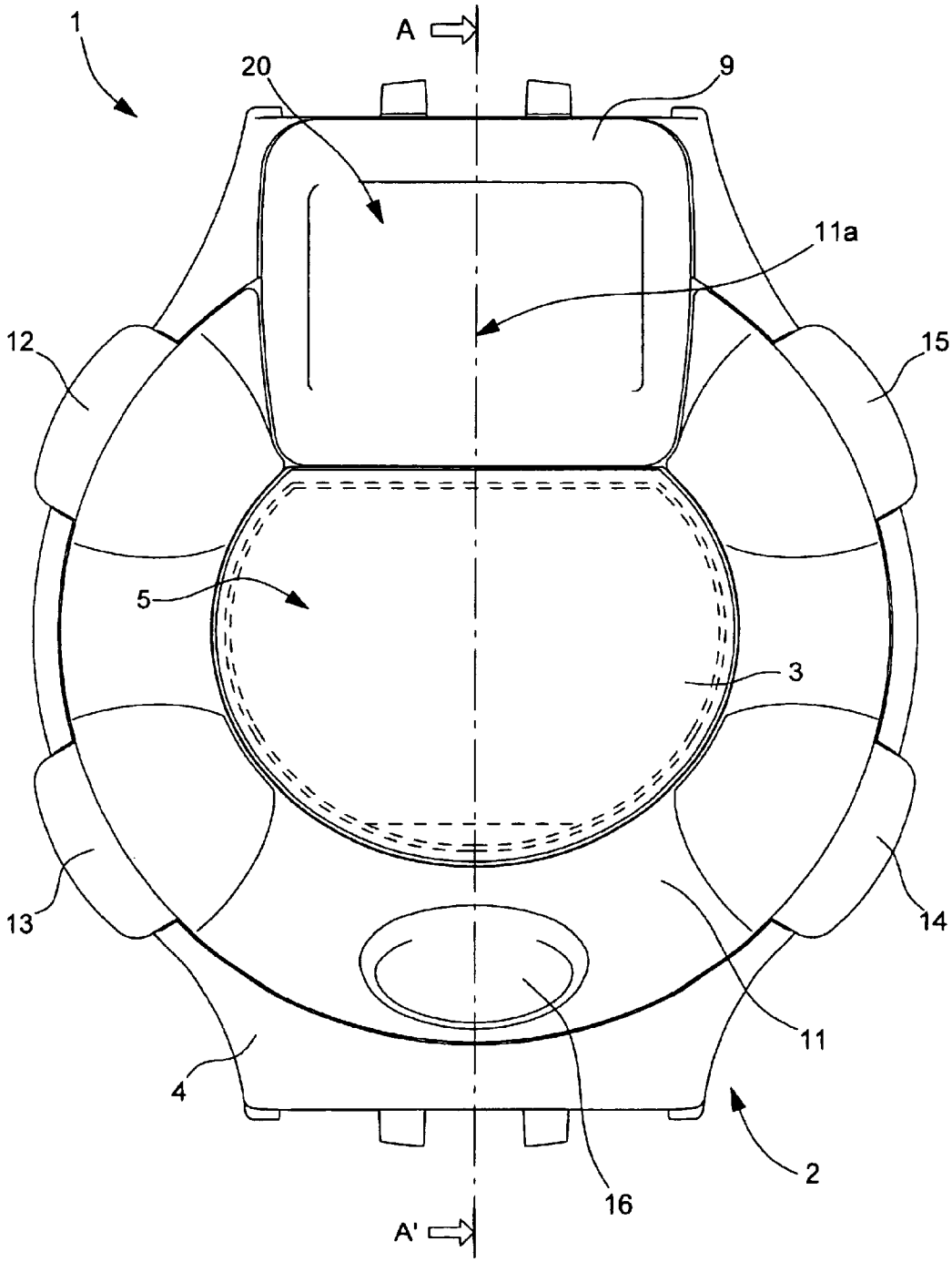
FIG. 1 is a plan view of a wristwatch forming a first embodiment of the invention.
Figure 2:
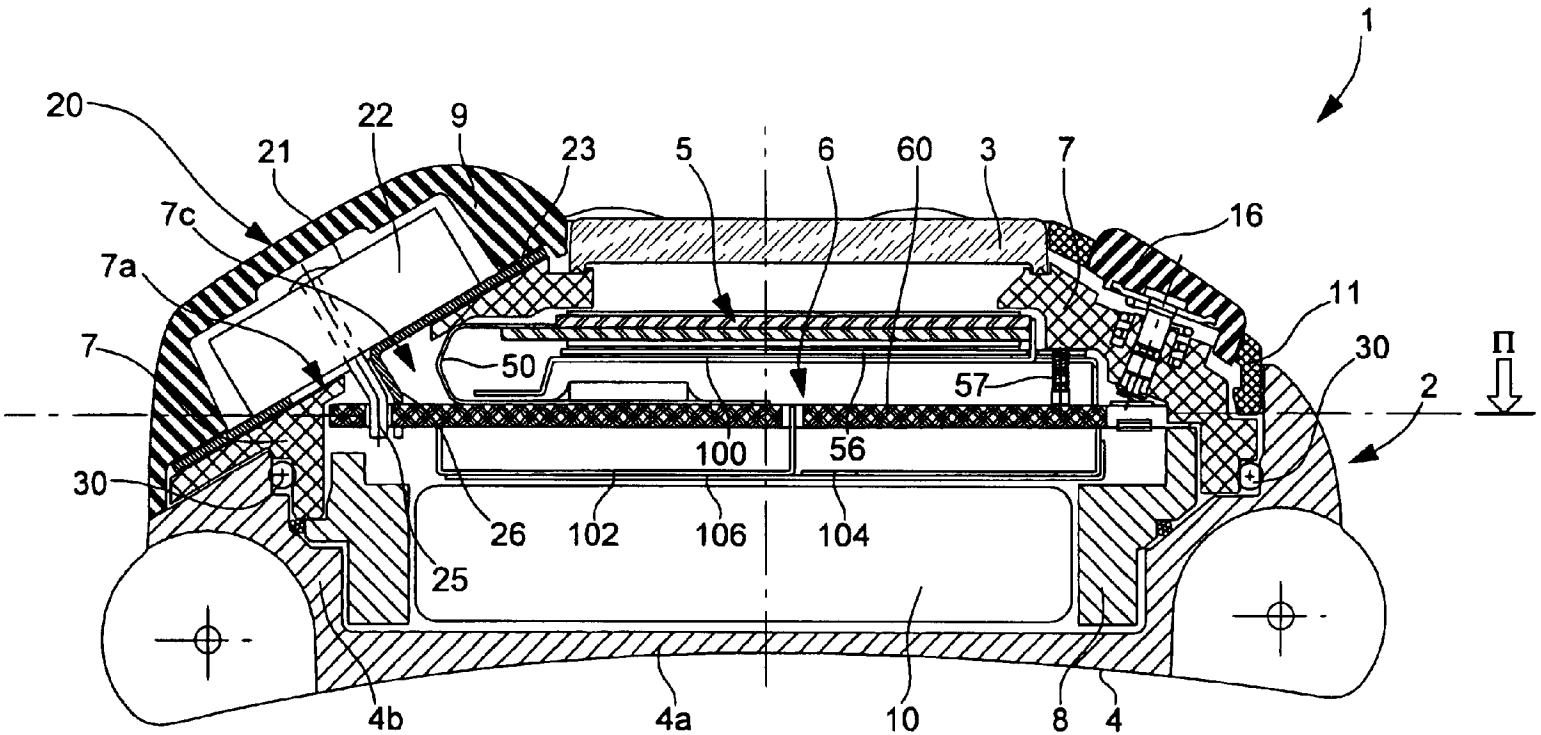
FIG. 2 is a cross-section of the wristwatch taken along the line A-A' of FIG. 1.
Figure 3A:
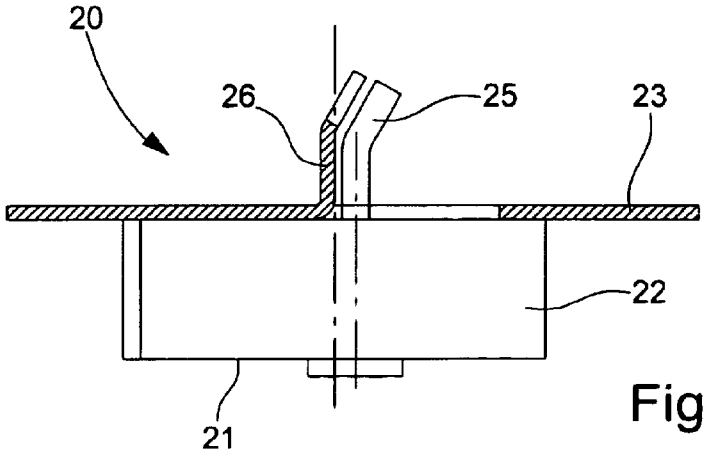
Figure 3B:
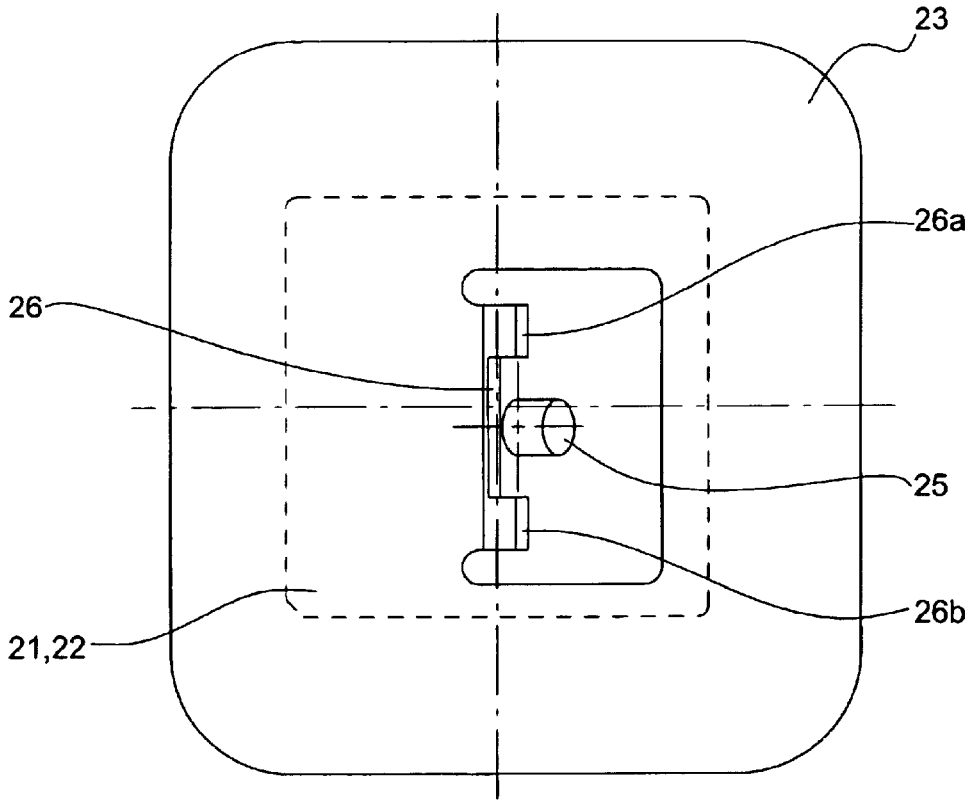
Figure 4A:
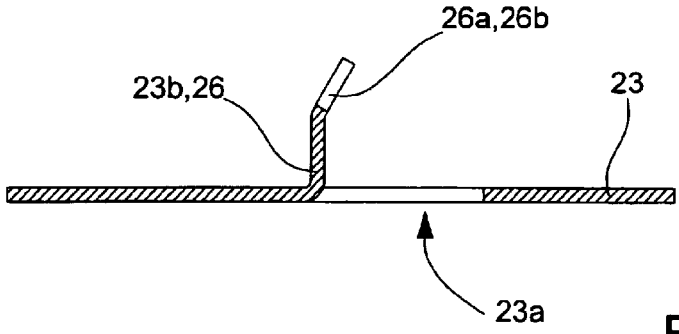
Figure 4B:
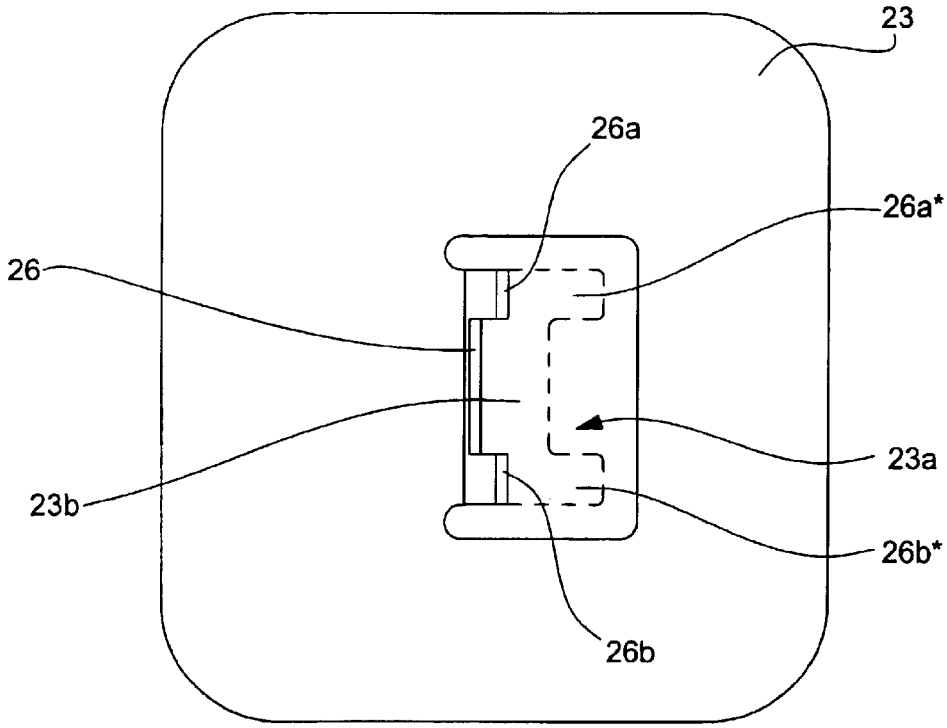
Figure 5:
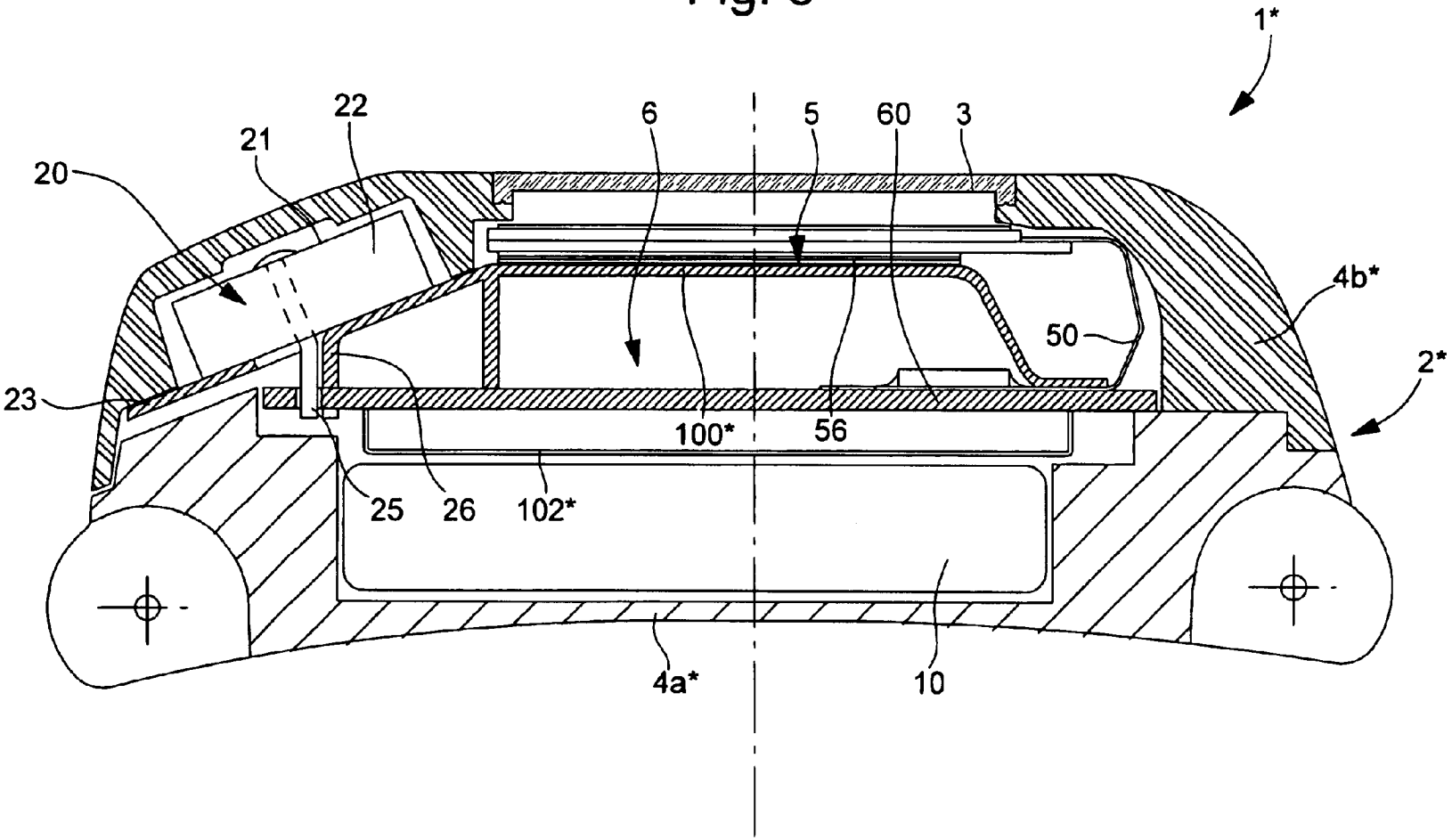

FIGS. 3*a* and 3*b* are respectively cross-sectional and plan views of the patch type antenna fitted to the wristwatch of FIG. 1;

FIGS. 4*a* and 4*b* are respectively cross-sectional and plan views of the ground plane of the antenna illustrated in FIGS. 3*a* and 3*b*; and FIG. 5 is a cross-section of the same type as FIG. 2 illustrating a second embodiment of the invention also taking the form of a wristwatch and wherein the ground plane of the antenna forms an integral part of a shielding plate of the instrument.

FIG. 1 shows a plan view of a portable electronic instrument according to the invention globally indicated by the reference numeral 1 and advantageously taking the form of a wristwatch. This wristwatch 1 is in particular fitted with an antenna 20 electrically connected to an electronic module (6 in FIG. 2) arranged inside the wristwatch. In this example, this antenna 20 is for receiving radio frequency signals transmitted by one or several distant transmission sources. More particularly, this antenna is for receiving satellite positioning and navigation signals, such as GPS signals ( Global Positioning System) originating from the American NAVSTAR system or other satellite positioning signals originating from similar systems, such as the Russian GLONASS system or the future European satellite positioning GALILEO system.

Wristwatch 1 has a similar general appearance to a conventional wristwatch and includes, in addition to antenna 20, a case globally denoted by the reference numeral 2, a wristband (not shown) attached to case 2, a glass 3, under which there is arranged a display device 5, enclosed in case 2 (such as a liquid crystal display), and control members 12 to 16, namely five push-buttons, one (16) placed at 6 o'clock and the other four (12 to 15) on the periphery of case 2.

FIG. 2 shows a cross-section of wristwatch 1 illustrated in FIG. 1 taken along the line A–A' parallel to the 6 o'clock–12 o'clock axis and passing through the centre of the wristwatch. One can again see case 2, glass 3, display device 5, patch antenna 20 and push-button 16, placed at 6 o'clock. Wristwatch 1 further includes, arranged inside case 2, an electronic module 6 including, in particular, a printed circuit board 60, on which the various electronic and electric components of the instrument are mounted, and an electric power source 10, powering in particular electronic module 6 and display device 5. In this example, the power source 10 is formed of a rechargeable accumulator placed at the bottom of case 2. This power source 10 could however be formed of a conventional battery (in which case a battery hatch would preferably have to be provided in the bottom of the case to allow it to be changed) or any other source capable of supplying adequate electric power.

As illustrated in FIG. 2, display device 5, namely a liquid crystal display, is superposed onto electronic module 6 and rests on a top face of said electronic module 6. Display device 5 is electrically connected to electronic module 6 by a flexible connector 50. An electro-luminescent sheet denoted by the reference numeral 56 is inserted between display device 5 and electronic module 6. This electro-luminescent sheet 56 is electrically connected to electronic module 6 by a pair of connectors, denoted 57, only one of them being illustrated by way of explanation in FIG. 2. Each of connectors 57 includes a stud and a contact spring.

It will be noted in FIG. 2 that the reference numerals 100, 102, 104 and 106 indicate metal plates for shielding the electronic circuits of module 6.

Case 2 includes an external body 4 having a bottom 4*a* and side walls 4*b* and an element forming a bezel 7 fitted onto external body 4. The bottom 4*a* and side walls 4*b* are preferably made in one piece, although it is possible to envisage providing two distinct parts assembled to each other, and they form together, in this example, a back cover-middle part of the wristwatch 1 onto which the wristband (not shown) is typically attached.

Bezel element 7 is fitted onto external body 4, or more exactly onto side walls 4*b* of external body 4, and supports glass 3, the latter preferably being bonded or welded onto element 7.

Advantageously, this bezel element 7 is made of a plastic material and glass 3 is for example welded by a known ultrasound method.

Bezel element 7 is preferably fitted in a water resistant manner onto the external body, for example via an O ring joint 30 placed between a shoulder arranged on the periphery of element 7 and a similar shoulder arranged on side walls 4*b* of external body 4.

According to this embodiment of the invention, antenna 20 is mechanically supported by bezel element 7 and rests on an outer face, denoted 7*a*, thereof. This antenna 20 can, if necessary, be bonded onto outer face 7*a* or held by other suitable securing means. Antenna 20 is advantageously arranged at 12 o'clock and in an inclined position with respect to the plane, denoted II, in which display device 5 and electronic module 6 are located. Consequently, the antenna is advantageously oriented substantially upwards in order to optimise reception of the GPS signals for the natural position of the wrist when the user reads the data on display device 5. In addition to antenna 20, it will be noted that element 7 also carries control members 12 to 16 of the wristwatch.

Wristwatch 1 preferably also includes an additional element 8 forming a casing ring arranged in case 2 between bezel element 7 and the bottom 4*a* of external body 4. Elements 7 and 8 form in a way the top and bottom portions of a container, inside which display device 5 and electronic module 6 are enclosed. Power source 10 is arranged between casing ring element 8 and the bottom 4*a* of external body 4. It will easily be understood that this accumulator could alternatively be enclosed between elements 7 and 8 with display device 5 and electronic module 6.

Preferably, external body 4 is made of a metallic material and bezel element 7 (and element 8) is made of plastic material. An exterior element, denoted by the reference numeral 11 (cf. FIG. 1), of essentially annular shape is also fitted onto element 7, for example, by snap fitting, in order to cover said element 7. In this example, exterior annular element 11 is preferably made in a similar material to the material used to make external body 4 and has an aperture 11*a* (indicated in FIG. 1) in which antenna 20 is housed. A protective cap made of dielectric material 9 is also added to bezel element 7 in order to protect antenna 20 from the external environment. Alternatively, it will easily be understood that exterior annular element 11 and protective cap 9 could be made in one piece of a material that does not disrupt the working of antenna 20.

Referring again more particularly to FIG. 2, it can be seen that patch antenna 20 is of essentially parallelepipedic shape including a radiating element 21 separated from a ground plane 23 of larger dimensions by a dielectric 22, such as a ceramic element. Radiating element 21 is fed by a feed conductor 25 insulated from ground plane 23 and passing through dielectric 22 to be connected to electronic module 6, element 7 being provided with an aperture 7*c* for the passage of feed conductor 25. Ground plane 23 is itself electrically connected to the electronic module by a separate ground conductor 26 also passing through aperture 7*c*.

According to the invention, antenna 20 thus rests on outer face 7*a* of bezel element 7 via its ground plane 23. In the solutions of the prior art, this type of antenna is generally disposed on the surface of the electronic module with the drawbacks that have already been mentioned, namely more significant interference with the electronic circuits of the watch requiring specific shielding and the impossibility, if it is desired, of making the case of a metallic material. It will be noted that ground plane 23 of antenna 20 will preferably be bonded to outer face 7*a* of bezel element 7.

One will now refer to FIGS. 3*a*, 3*b*, 4*a* and 4*b*, which illustrate in more detail the particular structure of patch antenna 20 and particularly its ground plane 23. FIGS. 3*a* and 3*b* thus show respectively a cross-sectional view and a plan view of patch antenna 20 used within the scope of the first embodiment of the invention. One can again see radiating element 21, dielectric 22 and ground plane 23, as well as feed conductor 25 and ground conductor 26.

As illustrated in FIG. 3*b*, feed conductor 25 is off centre with respect to the centre of symmetry of radiating element 21, particularly such that antenna 20 has circular type polarisation. It will be noted that this off centre position also contributes to the definition of the antenna's impedance. The distance separating feed conductor 25 from ground conductor 26 is also selected conventionally to allow the antenna to be matched in a suitable manner to the associated reception circuit. It will be noted that the specific geometry of connector 25, 26 defines the characteristic impedance of the antenna.

More particularly, according to the invention, ground plane 23 includes two feet 26*a* and 26*b* extending outside ground plane 23 and forming ground conductor 26. It will be noted that these feet 26*a*, 26*b* are arranged such that they are disposed symmetrically on either side of feed conductor 25. FIGS. 4*a* and 4*b* show in more detail the structure of ground plane 23. This ground plane 23 is advantageously made from a metal plate formed by a conventional stamping method. This plate is initially cut out such that it has a central opening 23*a* into which there projects an extensions 23*b*, essentially in the shape of a "U" opening into central opening 23*a* and from which the feet 26*a*, 26*b* are eventually formed. The structure of ground plane 23, at the end of the cutting operation, is illustrated in dotted lines in FIG. 4*b*, the feet being denoted at this stage by the reference numerals 26*a and 26*b. Extension 23*b* is then folded down such that feet 26*a*, 26*b* thereby formed extend outside ground plane 23 as illustrated. It will be noted that feed conductor 25 is formed so as to have a similar profile as illustrated in FIGS. 3*a* and 3*b*. In this example, the profile of feet 26*a*, 26*b* and of feed conductor 25 is chosen so as to allow antenna to have an inclined position with respect to the electronic module on which this antenna is connected.

According to the invention, it will be noted that ground conductor 26 forms an integral part of ground plane 23, thus greatly simplifying the connection of antenna 20 to electronic module 6, although antenna 20 does not rest directly on electronic module 6. As is illustrated in FIG. 2, it will be noted that ground conductor 26, namely feet 26*a* and 26*b* of ground plane 23, and feed conductor 25 are directly connected by welding to printed circuit board 60 of electronic module 6, corresponding contact orifices being arranged in printed circuit board 60.

It will also be noted that the antenna connector proposed, formed of conductors 25, 26, defines a line whose impedance is adapted between the antenna and the line (not shown) on printed circuit board 60 and thus minimizes mismatch loss.

In the example of FIGS. 1 and 2, it will be noted that the antenna is mechanically supported by bezel element 7, which is fitted onto external body 4. This construction is particularly advantageous for making a portable instrument including a metal external body. For fuller details concerning this specific construction, reference can be made to European Patent Application No. 01202593.8 of May. 7, 2001 in the name of the present Applicant, for which priority is claimed.

It will be noted that the particular structure of the antenna and its ground plane, which forms the subject of the present invention, is nonetheless not limited to the specific implementation of FIGS. 1 and 2. It is thus perfectly possible to envisage using a similar structure in a different construction. FIG. 5 shows, for example, another embodiment of the invention that can be envisaged, wherein the ground plane of the antenna forms an integral part of a shielding plate of the portable electronic instrument. Unlike the embodiment of FIGS. 1 and 2, it will be noted that ground plane 23 of the antenna no longer rests on an additional element (such as bezel element 7) but is secured to the shielding of the instrument's electronic circuits. It goes without saying that the construction of FIG. 5 is appropriate for making a portable instrument provided with a non-metallic exterior (for example plastic), or, generally, a material that does not disrupt the working of the antenna.

In the illustration of FIG. 5, the wristwatch forming another embodiment of a portable electronic instrument according to the invention is globally denoted by the reference numeral 1*. One essentially sees again in the cross-section illustrated (taken along the 6 o'clock–12 o'clock axis of the watch), the same elements as in the cross-section of FIG. 2, namely glass 3, display device 5 connected by its flexible connector 50 to printed circuit board 60 of electronic module 6, the electro-luminescent sheet placed under display device 5, power source 10 and patch antenna 20 with its radiating element 21, its dielectric 22, its ground plane 23 and its feed conductor 25 and ground conductor 26. These elements 5, 6, 10 and 20 are enclosed in a case denoted here by the reference numeral 2* and formed of two interleaved parts 4*a and 4*b. Bottom part 4*a forms, in this example, a back cover-middle part of the instrument and element 4*b added to the top part forms, in a way, a cover for the case of instrument 4*b**.

As illustrated schematically in FIG. 5, the instrument also includes shielding elements 100* and 102* arranged respectively on the top and bottom faces of printed circuit board 60. More particularly, top shielding element 100* is formed of a stamped metal plate whose end portion forms ground plane 23 of antenna 20. Thus, in this example, and unlike the preceding embodiment, the ground plane of antenna 23 forms an integral part of the shielding structure of the antenna. It is to be noted that the antenna is always placed at a distance from printed circuit board 60 and does not rest directly on a face of said printed circuit board 60. This configuration frees space on electronic module 6 and allows most of the electric and electronic components of the instrument to be arranged behind the antenna in order to improve its operating features. Moreover, improved flexibility is consequently obtained for the exterior design of the instrument. Finally, the electric connection of antenna 20 to electronic module 6 remains facilitated by the fact that ground conductor 26 of the antenna forms an integral part of ground plane 23.

In this second embodiment, it will be noted that, except for the fact that ground plane 23 forms a whole with shielding plate 100*, the configuration of ground plane 23 of antenna 20 remains substantially unchanged with respect to the configuration illustrated in FIGS. 3*a*, 3*b*, 4*a* and 4*b*. It is consequently not illustrated again.

It will also be noted that antenna 20 is again arranged in an inclined plane with respect to the plane in which display device 5 and electronic module 6 are located, in order to optimise the orientation of the antenna for receiving positioning signals when the data displayed by display device 5 are normally read.

It will be understood generally that various modifications and/or improvements that are obvious to those skilled in the art can be made to the embodiments described in the present description, without departing from the scope of the invention defined by the annexed claims. In particular, the present invention is not limited to a wristwatch as illustrated in the Figures, but can be applied to any other portable instrument capable or incapable of being worn on the wrist. Furthermore, although the antenna is always illustrated as being arranged at 12 o'clock, this antenna can of course be arranged in other off-centre positions, for example at 9 o'clock, 3 o'clock or 6 o'clock, or even on the diagonals.

What is claimed is:

1. A patch type antenna for portable electronic instrument of small volume, including a radiating element separated from a ground plane by a dielectric and including feed and ground conductors for the electrical connection of said radiating element and said ground plane, respectively, to an electronic module, said ground plane being formed of a stamped metal plate having a central opening through which said feed conductor passes, said ground plane including an extension extending into said central opening and which is bent outside said ground plane in an opposite direction to that of said radiating element, said extension forming said ground conductor of the antenna, wherein said extension essentially has the shape of a "U" opening so as to form first and second feet.

2. The antenna according to claim 1, wherein said ground plane forms an integral part of a shielding plate of the portable electronic instrument.

3. The antenna according to claim 1, wherein said feet extend outside said ground plane so as to allow the antenna to have an inclined position with respect to said electronic module.

4. The antenna according to claim 1, wherein said feed conductor is off centre with respect to the centre of symmetry of the radiating element.

5. The antenna according to claim 1, wherein said first and second feet forming said ground conductor are arranged such that they are disposed symmetrically on either side of the feed conductor.

6. A portable electronic instrument of small volume, such as a wristwatch, including an electronic module and a patch type antenna electrically connected to said electronic module, said antenna including a radiating element separated from a ground plane by a dielectric and including feed and ground conductors for the electrical connection of said radiating element and said ground plane, respectively, to said electronic module, said ground plane being formed of a stamped metal plate having a central opening through which said feed conductor passes, said ground plane including an extension extending in said central opening and which is bent outside the ground plane in an opposite direction to that of said radiating element to directly connect said ground plane to said electronic module, this extension forming said ground conductor of the antenna, wherein said extension essentially has the shape of a "U" opening so as to form first and second feet.

7. The instrument according to claim 6, wherein said ground plane forms an integral part of a shielding plate of the portable electronic instrument.

8. The instrument according to claim 6, wherein said antenna is arranged in an inclined position with respect to the plane in which said electronic module is located.

9. The instrument according to claim 6, wherein said first and second feet forming said ground conductor are arranged such that they are disposed symmetrically on either side of the feed conductor.

* * * * *